US006098354A

United States Patent [19]

Skandis

[11] Patent Number: 6,098,354

[45] Date of Patent: Aug. 8, 2000

[54] MODULAR FLOOR TILE HAVING REINFORCED INTERLOCKING PORTIONS

[75] Inventor: Christine J. Skandis, Kalamazoo, Mich.

[73] Assignee: Dante Design Associates, Inc., Kalamazoo, Mich.

[21] Appl. No.: 09/056,239

[22] Filed: Apr. 7, 1998

Related U.S. Application Data

[60] Provisional application No. 60/042,951, Apr. 7, 1997.

[51] Int. Cl.[7] ..... E04F 15/22

[52] U.S. Cl. ..... 52/177; 52/581; 52/591.1; 52/591.3

[58] Field of Search ..... 52/177, 581, 591.1, 52/591.3

[56] References Cited

U.S. PATENT DOCUMENTS

| | | | |
|---|---|---|---|
| 3,438,312 | 4/1969 | Becker et al. | 52/177 |
| 3,657,852 | 4/1972 | Worthington et al. | 52/591.3 |
| 3,802,144 | 4/1974 | Spica | 52/177 |
| 3,909,996 | 10/1975 | Ettlinger, Jr. et al. | 52/581 |
| 4,027,451 | 6/1977 | Bustin | 52/177 |
| 4,054,987 | 10/1977 | Forlenza . | |
| 4,167,599 | 9/1979 | Nissinen | 52/177 |
| 4,287,693 | 9/1981 | Collette . | |
| 4,296,160 | 10/1981 | Forlenza . | |
| 4,436,779 | 3/1984 | Menconi et al. . | |
| 4,478,901 | 10/1984 | Dickens et al. . | |
| 4,590,731 | 5/1986 | DeGooyer | 52/581 |
| 4,807,412 | 2/1989 | Frederiksen | 52/177 |
| 4,860,510 | 8/1989 | Kotler . | |
| 4,930,286 | 6/1990 | Kotler | 52/177 |
| 5,628,160 | 5/1997 | Kung | 52/177 |
| 5,713,175 | 2/1998 | Mitchell | 52/177 |
| 5,992,106 | 11/1999 | Carling et al. | 52/177 |

*Primary Examiner*—Carl D. Friedman
*Assistant Examiner*—Phi Dieu Tran A
*Attorney, Agent, or Firm*—Howard & Howard

[57] ABSTRACT

A modular floor tile having interlocking members which are reinforced to prevent a gap from forming between adjacent tiles during use. The tile comprises a plastic support grid having a rectangular configuration bounded by a perimeter wall on four sides and including a latticework of support members on the underside thereof. The support members are integrally formed as part of the tile and include leg portions extending downwardly therefrom which have common lengths in order to provide a single plane of contact at the supporting floor. Interlock members are coupled to and extend outward from the perimeter wall to enable removable attachment of additional modular tiles of similar design at corresponding edges thereof. A continuous sheet of plastic can be integrally formed in uniform thickness with a top surface of the tile to provide a flat surface on which recreational games can be played on an interlocked grid of tiles.

5 Claims, 2 Drawing Sheets

MODULAR FLOOR TILE HAVING REINFORCED INTERLOCKING PORTIONS

RELATED APPLICATION

This invention claims all the benefit and priority of U.S. Provisional Application Serial No. 60/042,951, filed Apr. 7, 1997 and entitled "Modular Floor Tile Having Reinforced Interlocking Portions".

BACKGROUND OF THE INVENTION

1. Field of the Invention

This invention relates to plastic tiles which are supported on a surface to provide a playing surface for recreational games and other activities. More particularly, the present invention pertains to modular tiles of plastic composition which are interlocked to form a playing surface and which are provided with reinforced interlocking portions to prevent failure thereof as a result of sudden forces imparted during use.

2. Description of the Related Art

A wide variety of floor coverings have been developed for use as playing surfaces for athletic activities. Modular floor coverings have grown in popularity due to their capability of being removable—enabling an arena used for summer sports during cold weather, such as soccer, to be used for other sports, such as in-line skating, during warm weather. The arena can thereby be used a greater amount of time for more sports throughout the year.

Structurally, modular floor coverings typically comprise several interlocked plastic tiles in a grid-like configuration which have an underside provided with a cross pattern of grid surfaces and support legs depending therefrom. Examples of modular floor coverings are shown in U.S. Pat. No. 4,054,987 to Forlenza, U.S. Pat. No. 4,436,799 to Menconi, and U.S. Pat. No. 4,930,286 to Kotler. The interlocking members typically comprise a laterally extending loop member which is adapted to receive a detent member on an adjacent panel to mount the adjacent panel thereto. The loop member is typically a thin member which extends laterally from the support grid on a panel.

Although modular floor tiles have grown in popularity because of their versatility, the modular floor tiles, such as those shown in the above identified patents, typically have problems during use thereof. One typical problem encountered during use of these tiles is failure of the loop members under the loading experienced by the loop members during use.

The failure of the interlocking members between adjacent panels creates a dangerous condition on the flooring surface because the failed interlocking portions allow adjacent panels to peel or warp at their edges. This can cause players to trip, fall or catch their feet on the seams between the failed panels, causing injuries.

SUMMARY OF THE INVENTION

This invention overcomes the limitations of the prior art by providing a plurality of modular tiles for forming a floor covering comprising a support grid having a top surface and an underside forming a generally rectangular configuration bounded by a perimeter wall. First and second interlock members extend outwardly from opposing sides of the perimeter walls, respectively, for providing removable attachment of additional modular tiles. The first interlock member has a U-shaped wall defining a aperture therein and the second interlock member has a U-shaped post dimensioned to be received in the aperture of the first interlock member and includes a detent for interlocking with the perimeter wall adjacent the first interlock member to securely interconnect adjacent modular tiles. The modular tile is characterized by the first interlock member including a lip extending radially from the U-shaped wall for abutting against the underside of the interconnected tile for providing additional structural reinforcement between the adjacent tiles.

Other objects and features will be apparent to those skilled in the art, based on the following detailed description, taken in combination with the accompanying drawings.

BRIEF DESCRIPTION OF THE DRAWINGS

The invention will now be described with reference to the drawings in which.

DETAILED DESCRIPTION OF THE PREFERRED EMBODIMENTS

Figure 1:
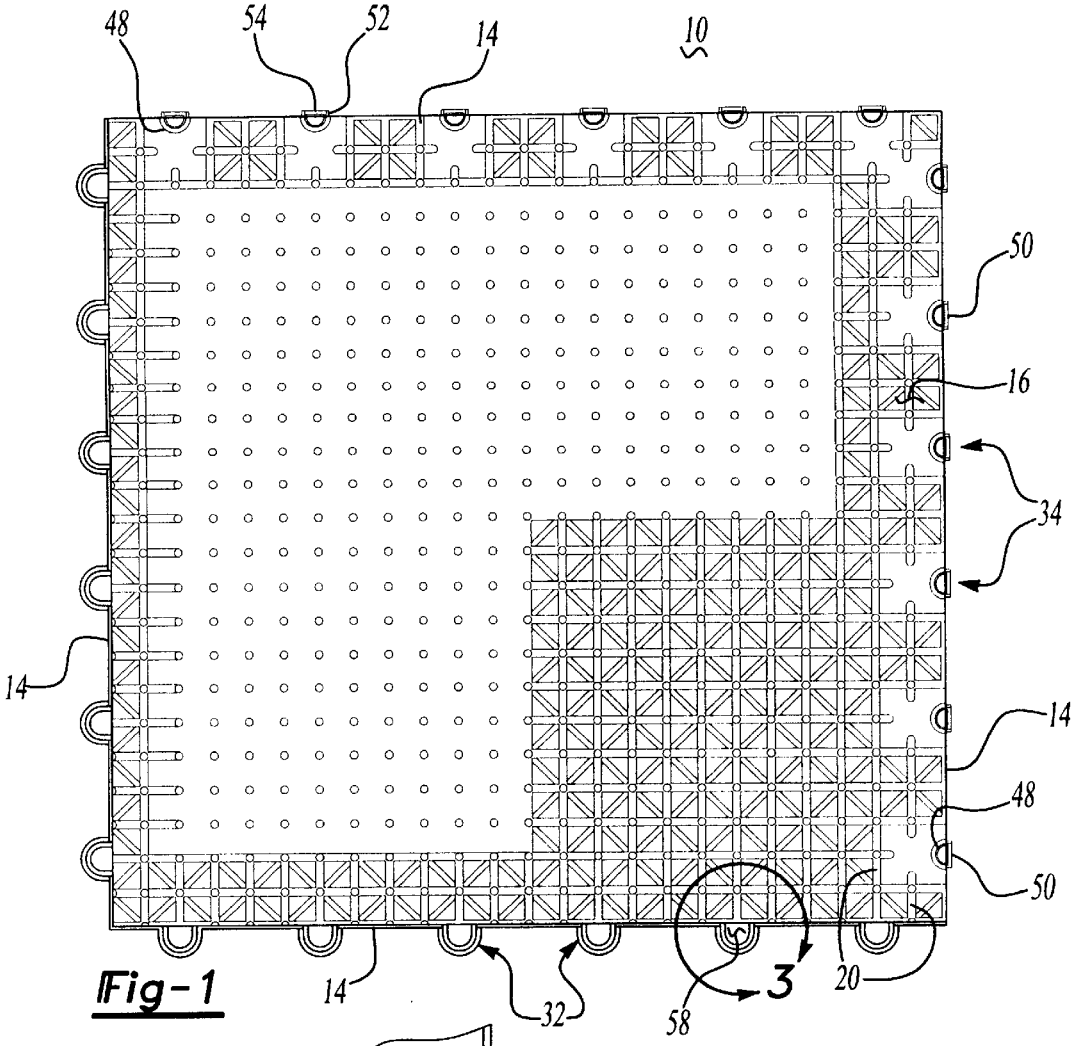
FIG. 1 is a bottom plan view of a modular floor tile according to the invention.

Referring now to the drawings, FIG. 1 discloses a modular, plastic tile 10 suitable for application as part of floor covering for a tennis court, in-line skating area, basketball court or other athletic or general flooring area. The tile 10 has a top surface 12 which is preferably formed with a continuous, flat configuration suitable for such sporting events. The tile 10 is preferably formed in a rectangular configuration as shown in FIG. 1 bounded on all sides by perimeter walls 14.

Figure 3:
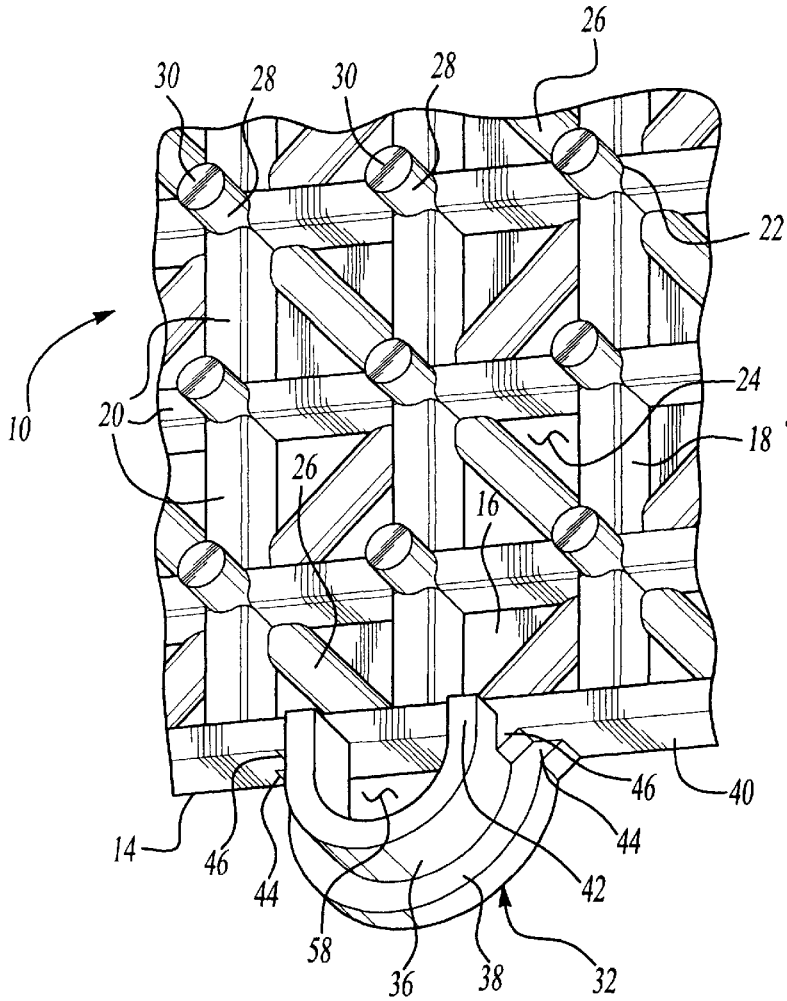
FIG. 3 is an enlarged perspective view of the region marked III in FIG. 1.

The tile 10 also has an underside 16 which comprises a support grid 18, shown in FIG. 1 and in greater detail in FIG. 3. The support grid 18 comprises a latticework of elongated members 20 which intersect at junctions 22. A plurality of interstitial openings 24 are thereby formed between the elongated members 20, with each bounded on four corners by the corresponding junctions 22. The members 20 provide structural support to the tile 10 during use. Additional structural support can be provided by protrusions 26 which extend from the underside 16 of the tile 10 and traverse diagonally across the interstitial openings 24.

A plurality of support legs 28 of common length are integrally formed with, and depend from, the junctions 22 in a generally orthogonal orientation with respect to the support grid 18. The support legs 28 have a distal end 30 which is adapted to abut a floor surface when the tiles 10 are rested thereon.

The tile 10 also includes first and second interlock members 32 and 34 which extend outwardly from the perimeter walls 14. Preferably, a plurality of first interlock members 32 (typically, six) extend outwardly from a pair of adjacent perimeter walls 14 and a plurality of second interlock members 34 extend outwardly from the remaining perimeter walls 14. It has been found that this configuration of first and second interlock members 32 and 34 enables a user to quickly assemble several tiles 10 into a floor surface.

Figure 2:
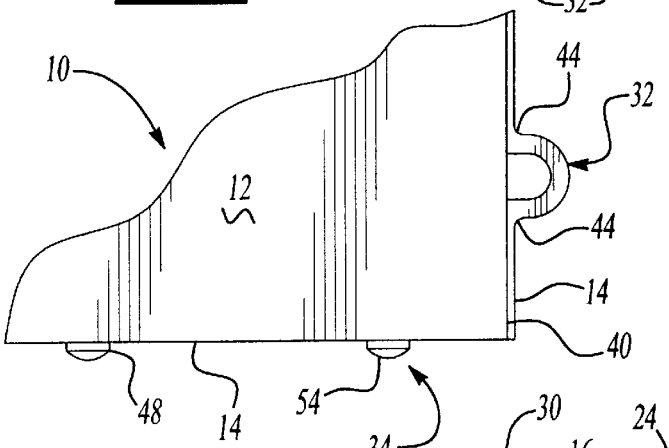
FIG. 2 is a fragmentary top plan view of a corner portion of the modular floor tile of FIG. 1.

The first interlock member 32 is shown in FIGS. 1–2 and in greater detail in FIG. 3. The first interlock member 32 comprises a U-shaped wall 36 provided with a radially-extending lip 38 thereon. The perimeter walls 14 having the first interlock members 32 are provided with a laterally-extending laminar plate 40 which extends from the perimeter wall 14. The lip 38 preferably extends radially from an upper portion of the wall 36. Here, "upper" denotes the direction toward the top surface 12 of the tile 10, and "lower" denotes the direction away from the top surface. Further, the wall 36 also includes a lower portion 42 which depends from the lip 38 and beyond a lower edge of the perimeter wall 14 generally coplanar with the support grid 18.

First and second gussets 44 and 46 are provided between the plate 40 and either side of the lip 38 and the lower portion 42 of the wall 36, respectively. The gussets 44 and 46 provide additional structural support when the first interlock member 32 is subjected to heavy loading during use, such as substantial shear forces, to prevent failure of the first interlock member 32.

The second interlock member 34 comprises a post 48 having an outwardly-facing flat surface 50 thereon. The flat surface 50 has a distal end 52 which has a detent 54 thereon. The post 48 is configured as a hollow member having a longitudinal bore 56 which reduces the amount of material used thereby providing a cost savings during manufacture of the tile 10. It will be understood that the post 48 must have sufficient material to withstand the loading imparted thereto during use of the tile 10.

Figure 5:
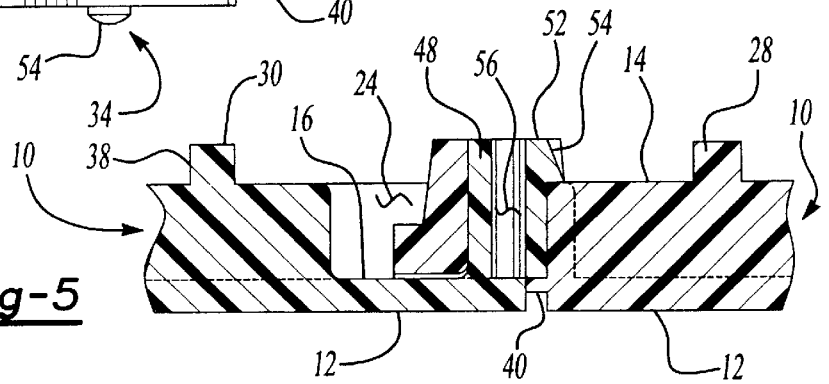
FIG. 5 is a cross-sectional view of the interlocked floor tiles taken along line 5—5 of FIG. 4.
Figure 4:
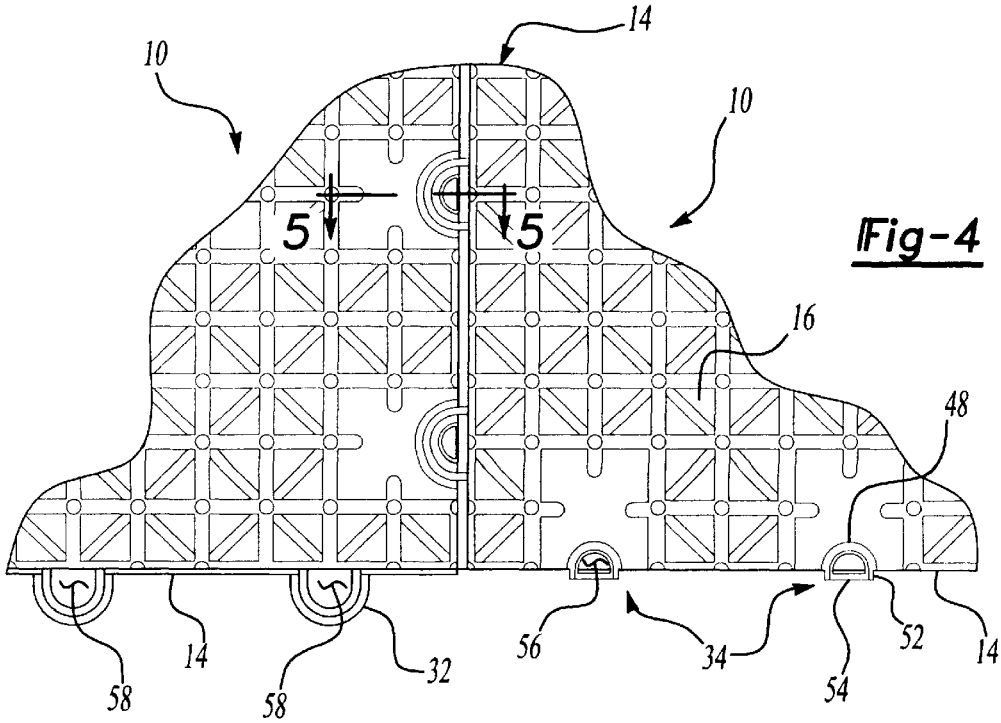
FIG. 4 is a fragmentary bottom view of a pair of adjacent, interlocked floor tiles according to the invention.

The first and second interlock members 32 and 34 enable removable attachment of additional modular tiles 10 of similar design at corresponding edges. The operation and components of the first and second interlock members 32 and 34 are more clearly illustrated in FIGS. 4–5. It will be understood that an interior portion of the wall 36 of the first interlock member 32 defines an aperture 58 which corresponds generally in size to an outer diameter of the second interlock member 34 to ensure a snug fit therebetween which allows little or no movement of the first interlock member 32 with respect to the second interlock member 34.

To mount a pair of tiles 10 together, a first tile 10 is placed on the surface to be covered by the modular floor tiles according to this invention. The second interlock members 34 of a second tile 10 are aligned with the first interlock members 32 of the first tile 10 so that each post 48 of the second tile 10 is aligned with a corresponding aperture 58 of the first tile 10. The second tile 10 is then lowered with respect to the first tile 10 so that the post 48 of the second interlock member 34 passes into the aperture 58 of the first interlock member. As each post 48 of the second tile 10 is received within the aperture 58 of the first tile 10, the detent 54 of the second interlock member 34 abuts the perimeter wall 14 of the first tile 10, and is pressed inwardly against the inherent spring bias of the material in the post 48. When the second tile 10 has been urged downwardly to the point where the detent 54 is free of the perimeter wall 14, the detent 54 springs outwardly so that it catches beneath the perimeter wall 14 of the first tile 10, thus securely mounting the second tile 10 to the first tile 10 by snap-fit engagement.

It will be understood that all second interlock members 34 on a perimeter wall 14 of the second tile 10 must be aligned with all corresponding first interlock members 32 of the first tile 10 although the mounting of a single first and second interlock member 32 and 34 is herein described. It will be further understood that at least four, and preferably six, interlock members 32 and 34 are provided on each corresponding perimeter wall 14 of a tile 10 to ensure a secure mounting between adjacent tiles 10.

It will be understood that the tiles can be separated by urging one tile upwardly with respect to another so that each detent 54 is dislodged from the adjacent tile 10.

The lip 38 of the first interlock member 32 provides additional structural reinforcement when adjacent tiles 10 are mounted together. An upper surface of the lip 38 rests directly against the underside 16 of the tile 10 which allows for greater force transmission and absorption between adjacent tiles 10 of the forces encountered by the first interlock member 32. Further, the gussets 44 and 46 provide additional structural reinforcement against shear loading of the first interlock member 32. It will be understood that the gussets 44 and 46 are preferably 45-degree braces, but any known suitable reinforcement which accomplishes the same function as the gussets is acceptable as a substitution therefor. The wall 36 also extends a greater degree between the top surface 12 and underside 16 than is taught by the prior art which provides additional structural reinforcement to the engagement between adjacent tiles 10.

Specific compositions applied to the tiles fabricated in accordance with the present invention include low density polyethylene and polypropylene copolymers. Other compositions of similar modulus will be known to those skilled in the art for acceptable substitution.

In addition to the other advantages previously set forth, the present flat surfaced tile offers all of the conveniences of a modular tile structure, including capability for individual replacement of single tiles, inexpensive construction in view of concrete or other acceptable subsurfaces, and similar advantages well known to those skilled in the art.

It will be further understood that the improved tiles 10 disclosed herein provide a distinct advantage over the prior art because the reinforced interlocking members 32 and 34 do not require a gap to be formed between adjacent tiles to absorb lateral forces imparted thereto during use. Rather, the interlocking members disclosed herein can absorb operational forces without failure of the tile 10 during use. The absence of a gap between adjacent tiles 10 provides for a smoother floor during use resulting in a generally continuous planar surface formed by the top surfaces 12 of adjacent tiles 10.

It is understood that users of the floor surface formed by a plurality of interlocked tiles 10 prefer a continuous planar surface for games such as basketball, in-line hockey, etc. to prevent inadvertent deflections of the ball or puck due to imperfections in the floor surface. Additionally, the floor surface according to this invention prevents injuries due to tripping caused by gaps located between adjacent tiles as disclosed in prior art modular floors.

It will be further understood that, although the tiles described herein are described for use in conjunction with athletic activities, the tiles can also be placed on any floor surface and used as a floor covering.

Reasonable variation and modification are possible within the spirit of the foregoing specification and drawings without departing from the scope of the invention.

What is claimed is:

1. A plurality of modular tiles for forming a floor covering comprising:

a support grid having a top surface and an underside forming a generally rectangular configuration bounded by a perimeter wall;

first and second interlock members extending outwardly from opposing sides of said perimeter walls, respectively, for providing removable attachment of additional modular tiles;

said first interlock member having a U-shaped wall defining an aperture therein;

said second interlock member having a U-shaped post dimensioned to be received in said aperture of said first interlock member and including a detent for interlocking with said perimeter wall adjacent said first interlock member to securely interconnect adjacent modular tiles;

said modular tile characterized by said first interlock member including a U-shaped lip extending radially from said U-shaped wall for abutting against said underside of said interconnected tile for providing additional structural reinforcement to said first interlock member and between said adjacent tiles.

2. A modular tile as set forth in claim 1 further characterized by including a first gusset interconnected between said perimeter wall and said lip for providing structure support to said first interlock member.

3. A modular tile as set forth in claim 2 further characterized by including a second gusset interconnected between said perimeter wall and said U-shaped wall for providing additional structural support to said first interlock member.

4. A modular tile as set forth in claim 3 further characterized by said support grid including a latticework of intersecting elongated structural support members joined at junctions on said underside of said tile and forming a plurality of interstitial openings therebetween.

5. A modular tile as set forth in claim 4 further characterized by including a plurality of support legs of common length integrally formed and depending from said junctions in a generally orthogonal orientation with respect to the underside of the support grid.

* * * * *